US009044638B2

(12) United States Patent
Huang et al.

(10) Patent No.: US 9,044,638 B2
(45) Date of Patent: Jun. 2, 2015

(54) FOLDABLE TREADMILL

(71) Applicant: Dyaco International Inc., Taipei (TW)

(72) Inventors: Hsuan-Fu Huang, Taipei (TW); Shih-Wei Liu, Taipei (TW); Yi-Cheng Li, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 72 days.

(21) Appl. No.: 14/060,804

(22) Filed: Oct. 23, 2013

(65) Prior Publication Data

US 2014/0121067 A1 May 1, 2014

(30) Foreign Application Priority Data

Oct. 29, 2012 (TW) ..... 101140003 A

(51) Int. Cl.
*A63B 22/00* (2006.01)
*A63B 22/02* (2006.01)

(52) U.S. Cl.
CPC ..... *A63B 22/0235* (2013.01); *A63B 22/0023* (2013.01); *A63B 2210/50* (2013.01)

(58) Field of Classification Search
CPC ..... A63B 22/02–2022/0292; A63B 22/0023; A63B 2210/50; A63B 2210/56
USPC ..... 482/54
See application file for complete search history.

(56) References Cited

U.S. PATENT DOCUMENTS

| | | | | |
|---|---|---|---|---|
| 6,695,751 | B1 * | 2/2004 | Hsu | 482/54 |
| 2006/0003869 | A1 * | 1/2006 | Huang et al. | 482/54 |
| 2008/0188358 | A1 * | 8/2008 | Kuo | 482/54 |

FOREIGN PATENT DOCUMENTS

| | | |
|---|---|---|
| CN | 2586492 | 11/2003 |

* cited by examiner

*Primary Examiner* — Loan H Thanh
*Assistant Examiner* — Jennifer M Deichl
(74) *Attorney, Agent, or Firm* — WPAT, PC; Justin King

(57) ABSTRACT

An embodiment of this invention discloses a foldable treadmill comprising a bracket, a platform, a lifting device, a folding frame, a motor, a linear actuator, and a control board, wherein the bracket comprises two supporting sticks, two tracks, and a rear linkage connected with the supporting sticks, the lifting device comprises a rod connected with the bracket, and two pull members respectively arranged at one end of the rod, the folding frame comprises two bars and a link bar, in which the link bar has two ends respectively connect with one bar, a middle portion of each bar connects with the pull member of the lifting device, a front end of each bar is used as a pivotal point to rotate, and a rear end of each bar has a wheel placed in the track, and the linear actuator is horizontally laid on the rear linkage.

6 Claims, 5 Drawing Sheets

FOLDABLE TREADMILL

CROSS-REFERENCE TO RELATED APPLICATIONS

The entire contents of Taiwan Patent Application No. 101140003, filed on Oct. 29, 2012, from which this application claims priority, are incorporated herein by reference.

BACKGROUND OF THE INVENTION

1. Field of the Invention

The present invention relates to treadmills, and particularly relates to foldable treadmills.

2. Description of Related Art

Treadmills are devices allowing a user for walking or running in the same place. Usually, treadmills provide a moving platform with a wide conveyor belt driven by an electric motor or a flywheel. Various indoor treadmills have been developed as people are paying more and more attention to their health.

Numerous patent applications concerning treadmills have been applied. For example, Taiwan patent I234472 discloses a treadmill having an elongated deck, in which the front end of the deck can be raised with an angle, and the rear end of the deck can be folded toward a panel support of the treadmill, so that the treadmill is folded at a stored position.

One drawback of conventional foldable treadmills is that the folding mechanism is complicated. Components of the folding mechanism are arranged at a side of a motor, and thus a big housing is needed to cover them. In addition, a very little room is remained for placing a circuit board of the treadmill. Therefore, maintenance of the treadmill is difficult and inconvenient if the circuit board is needed to check or repair.

SUMMARY OF THE INVENTION

In one general aspect, the present invention relates to foldable treadmills having a simple folding mechanism and at least featuring in smaller housing and better arrangement than that of prior art.

According to an embodiment of this invention, a foldable treadmill is disclosed and comprises a bracket, a platform, a lifting device, a folding frame, a motor, a linear actuator, and a control board, wherein:

the bracket comprises two supporting sticks, two tracks with each track being arranged at a side of the supporting stick toward the platform, and a rear linkage with two ends respectively connected with one supporting stick;

the platform is arranged above the bracket and comprises a base frame, a running board arranged on the base frame, and a belt moving around the running board;

the lifting device comprises a rod connected with the bracket, and two pull members respectively arranged at one end of the rod;

the folding frame is arranged between the bracket and the platform, and comprises two bars and a link bar, in which the link bar has two ends respectively connect with one bar, and a middle portion of each bar connects with the pull member of the lifting device, and wherein a front end of each bar is used as a pivotal point to rotate, a rear end of each bar has a wheel placed in the track, and the folding frame can rotate around the pivotal point;

the motor is arranged near to a front end of the platform for providing driving force;

the linear actuator is horizontally laid on the rear linkage, one end of the linear actuator has a lifting tube connected with the link bar of the folding frame, whereby the linear actuator drives the lifting tube moving toward the link bar, so as to push the link bar of the folding frame, and thus cause the wheel moving forward, so as to rise up the lifting device, and thus rise up the front end of the platform, and whereby when the lifting tube is driven toward the linear actuator, the wheel will be pulled back to its original position, and thus lower the front end of the platform; and the control board is arranged at another side of the front end of the treadmill and arranged at the opposite side of the motor.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
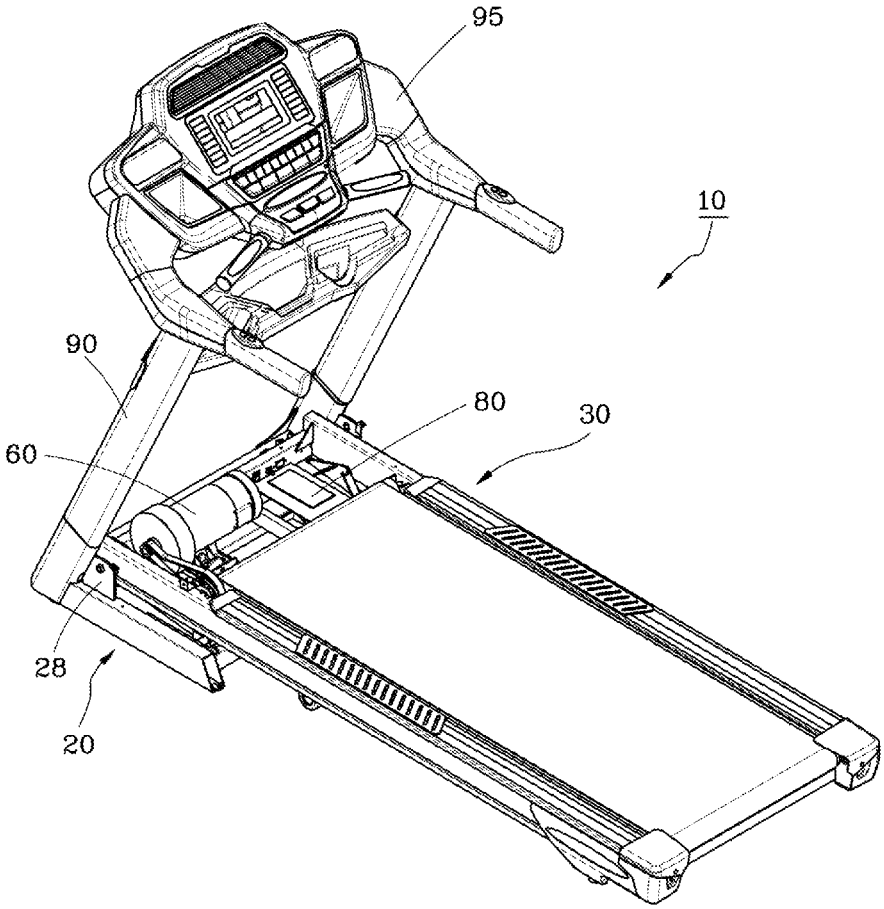
FIG. 1 is a perspective view showing a foldable treadmill according to a preferred embodiment of the present invention.
Figure 2:
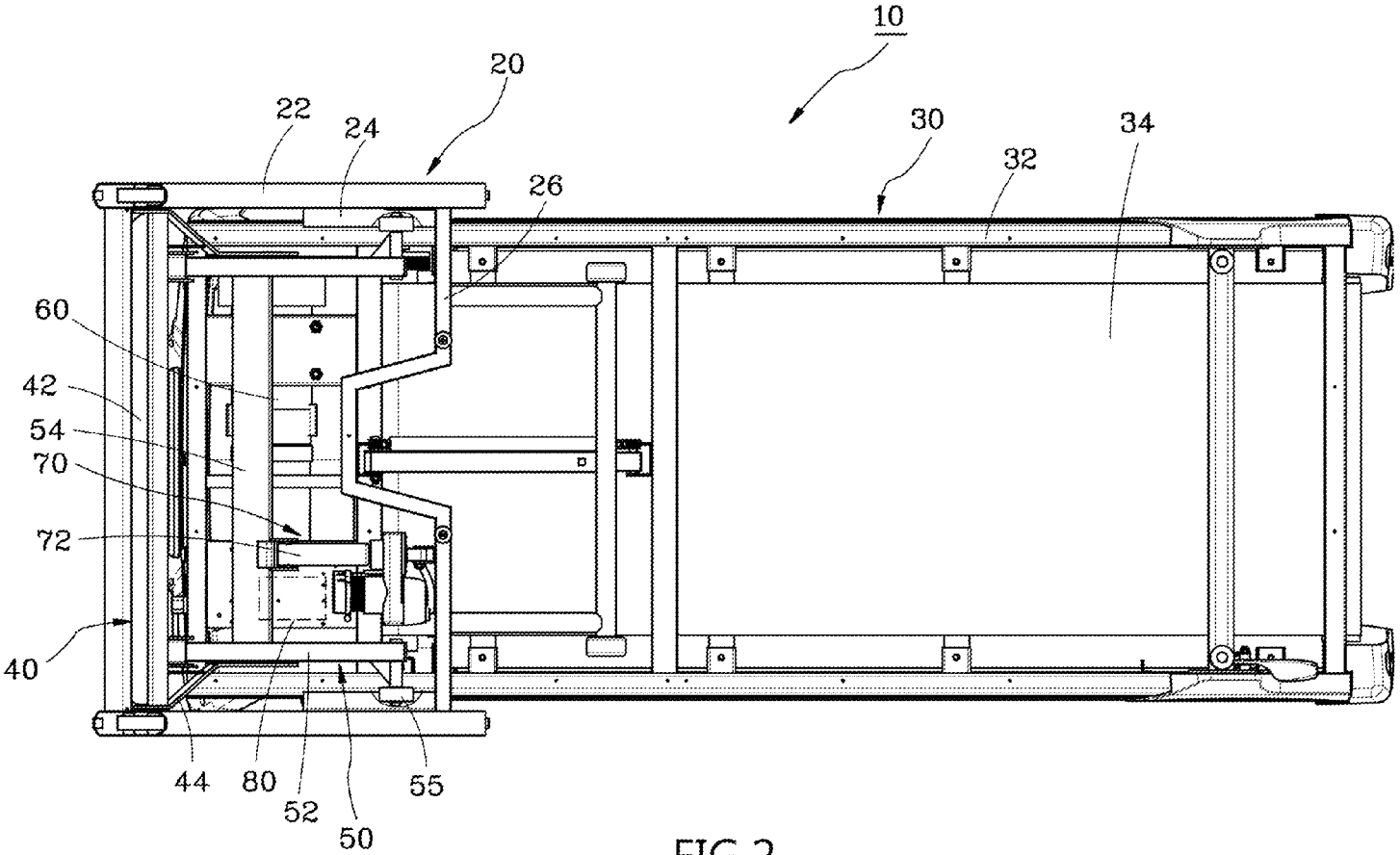
FIG. 2 is a bottom view showing the foldable treadmill according to the preferred embodiment of the present invention.
Figure 3:
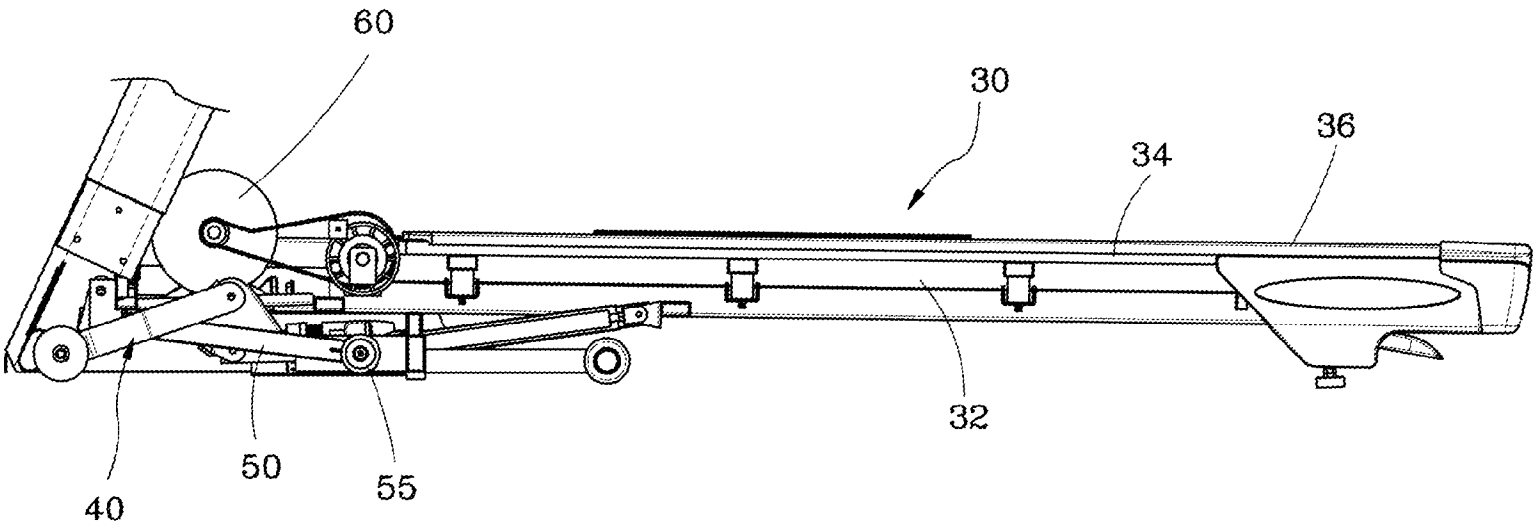
FIG. 3 is a side view showing the foldable treadmill according to the preferred embodiment of the present invention.
Figure 4:
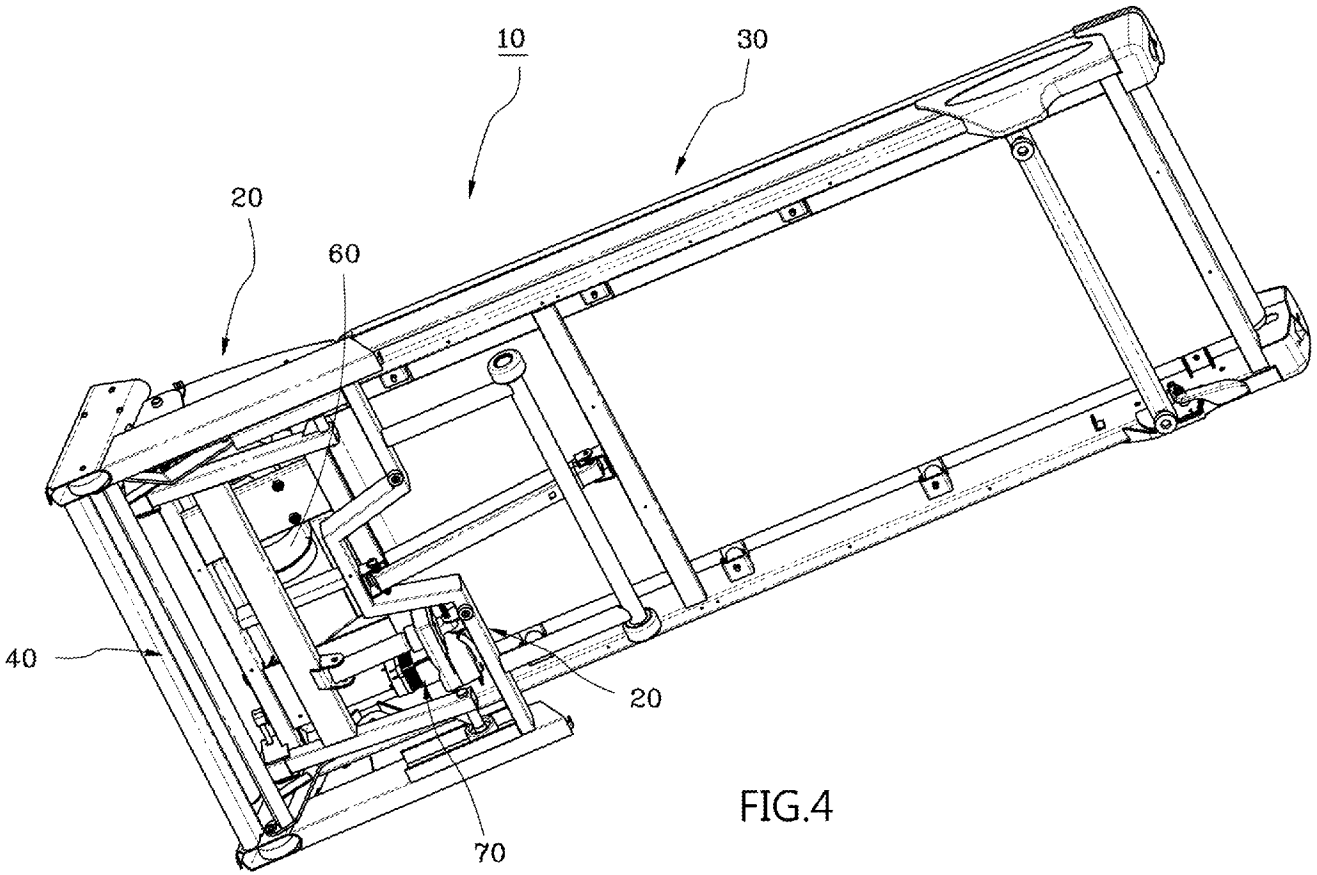
FIG. 4 is a bottom view taken from another view angle to show the foldable treadmill according to the preferred embodiment of the present invention.
Figure 5:
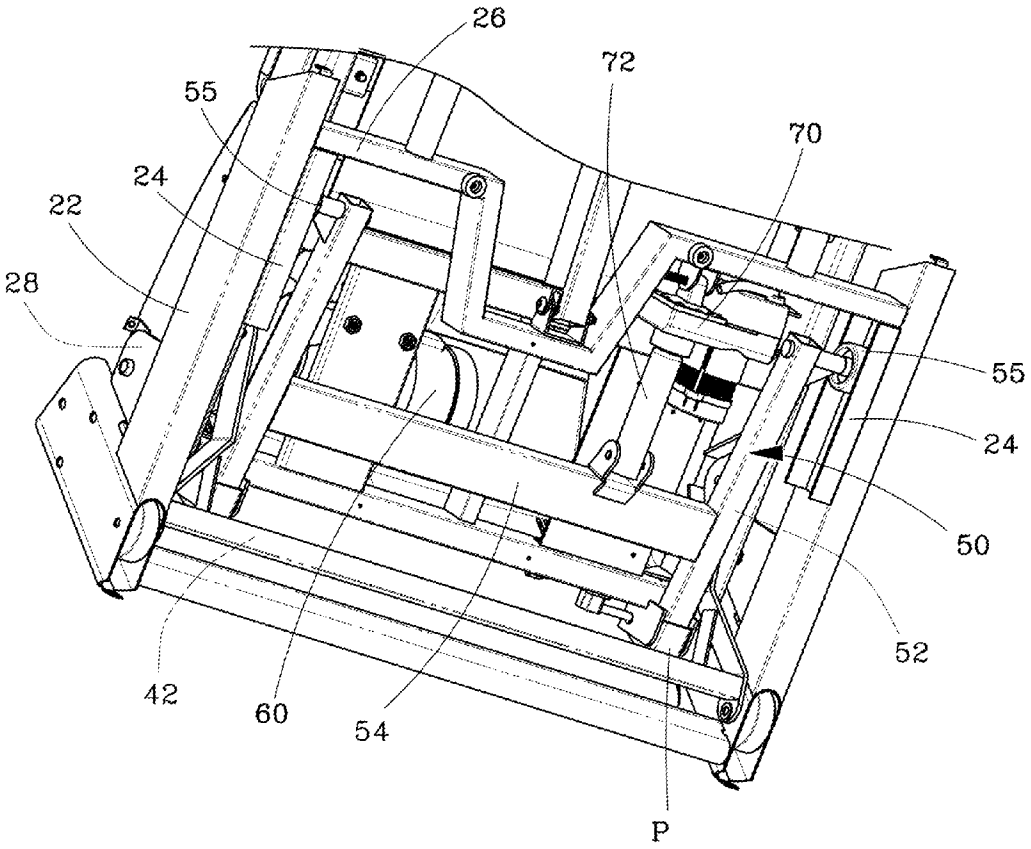
FIG. 5 is a partial enlarged view taken from a bottom view angle to show the foldable treadmill according to the preferred embodiment of the present invention.

Referring to FIGS. 1-5, a foldable treadmill 10 is disclosed according to a preferred embodiment of the present invention, in which FIG. 1 is a perspective view, FIG. 2 is a bottom view, FIG. 3 is a side view, FIG. 4 is another bottom view taken from another view angle, and FIG. 5 is a partial enlarged view taken from a bottom view angle.

Referring to FIGS. 1-5, the foldable treadmill 10 comprises a bracket 20, a platform 30, a lifting device 40, a folding frame 50, a motor 60, a linear actuator 70, and a control board 80.

In addition, the foldable treadmill 10 may further comprise a panel support 90 extending upward from the front end of the platform 30 and handles 95 extending horizontally from the panel support 90.

The bracket 20 comprises two supporting sticks 22, two U-shaped tracks 24 with each being arranged at a side of the supporting stick 22 toward the platform 30, a rear linkage 26 with two ends respectively connected with one supporting stick 22, and two sheets 28.

The platform 30 is arranged above the bracket 20 and comprises a base frame 32, a running board 34 arranged on the base frame 32, and a belt 36 moving around the running board 34.

The lifting device 40 comprises a rod 42 connected with the bracket 20, and two pull members 44 respectively arranged at one end of the rod 54.

The folding frame 50 is arranged between the bracket 20 and the platform 30, and comprises two bars 52 and a link bar 54, in which the link bar 54 has two ends respectively connect with one bar 52. A middle portion of each bar 52 connects with the pull member 44 of the lifting device 40.

One end (namely the front end) of each bar 52 is used as a pivotal point P to rotate, and the other end (the rear end) of each bar 52 has a wheel 55 placed in the U-shaped track 24. The folding frame 50 can rotate around the pivotal point P.

The motor 60 is arranged near to one end (namely the front end) of the platform 30 for providing driving force.

The linear actuator 70 is horizontally laid on the rear linkage 26 and placed in the bracket 20. One end of the linear actuator 70 has a lifting tube 72 connected with the link bar 54 of the folding frame 50. The linear actuator 70 can drive the lifting tube 72 moving toward the link bar 54, so as to push the link bar 54 of the folding frame 50, and thus cause the wheel 55 moving forward (in the direction of the front end of the treadmill 10), so as to rise up the lifting device 40, and thus rise up the front end of the platform 30 with an angle present between the platform 30 and ground. On the contrary, when the lifting tube 72 is driven toward the linear actuator 70, which will pull the wheel 55 back to its original position (as shown in FIG. 5), and thus lower the front end of the platform 30, and eventually recover the platform 30 to be horizontal.

By mechanism mentioned above, there is an abundant space to place the control board 80. The control board 80 can be placed in is arranged at a side of the front end of the treadmill and arranged at the opposite side of the motor.

Accordingly, embodiments of the present invention have at least the following advantages:

Conventional treadmills typically use linear actuators that are typically vertically arranged. On the contrary, the linear actuator 70 is horizontally arranged and laid on the rear linkage 26, and for covering the linear actuator 70 and other components, the treadmill 10 therefore can employ a housing smaller than that of prior art.

In addition, the linear actuator 70 is horizontally arranged in the bracket 20. A larger space can be constructed for placing the control board 80. Therefore, the arrangement is convenient for the maintenance of checking and repairing control board 80.

Moreover, the lifting device 40 and the folding frame 50 keep stationary when the foldable treadmill 10 is folding to a stored position. The folding mechanism of the present invention is simpler than that of prior art.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

Although specific embodiments have been illustrated and described, it will be appreciated by those skilled in the art that various modifications may be made without departing from the scope of the present invention, which is intended to be limited solely by the appended claims.

What is claimed is:

1. A foldable treadmill, comprising: a bracket, a platform, a lifting device, a folding frame, a motor, a linear actuator, and a control board, wherein:

the bracket comprises two supporting sticks, two tracks with each track being arranged at a side of a respective one of the two supporting sticks adjacent to the platform, and a rear linkage with two ends respectively connected with the two supporting sticks;

the platform is arranged above the bracket and comprises a base frame, a running board arranged on the base frame; and a belt moving around the running board;

the lifting device comprises a rod connected with the bracket, and two pull members respectively arranged at two ends of the rod;

the folding frame is arranged between the bracket and the platform, and comprises two bars and a link bar, in which the link bar has two ends respectively connected with the two bars, and a middle portion of each bar respectively connects with the two pull members of the lifting device, and wherein a front end of each of the two bars is used as a pivotal point to rotate the folding frame, and a rear end of each of the two bars has a wheel respectively placed in the two tracks;

the motor is arranged near to a front end of the platform for providing driving force;

the linear actuator is horizontally laid on the rear linkage, a first end of the linear actuator has a lifting tube connected with the link bar of the folding frame, whereby the linear actuator is configured to drive the lifting tube to move toward the link bar, so as to push the link bar of the folding frame, and thus cause the wheel to move forward, so as to raise the lifting device, and thus raise the front end of the platform, and whereby when the lifting tube is driven toward the linear actuator, the wheel will be pulled backward, and thus lower the front end of the platform; and the control board is arranged at a side of the front end of the treadmill and arranged at an opposite side of the motor.

2. The foldable treadmill as recited in claim 1, wherein the linear actuator is horizontally placed in the bracket.

3. The foldable treadmill as recited in claim 1, wherein the tracks are U-shaped.

4. A foldable treadmill, comprising: a bracket, a platform, a lifting device, a folding frame, a motor, and a linear actuator, wherein:

the bracket comprises two supporting sticks, two tracks with each track being arranged at a side of a respective one of the two supporting sticks adjacent to the platform, and a rear linkage with two ends respectively connected with the two supporting sticks;

the platform is arranged above the bracket and comprises a base frame, a running board arranged on the base frame, and a belt moving around the running board;

the lifting device comprises a rod connected with the bracket, and two pull members respectively arranged at two ends of the rod;

the folding frame is arranged between the bracket and the platform, and comprises two bars and a link bar, in which the link bar has two ends respectively connected with the two bars, and a middle portion of each bar respectively connects with the two pull members of the lifting device, and wherein a front end of each of the two bars is used as a pivotal point to rotate the folding frame, and a rear end of each of the two bars has a wheel respectively placed in the two tracks;

the motor is arranged near to a front end of the platform for providing driving force;

the linear actuator is horizontally laid on the rear linkage, a first end of the linear actuator has a lifting tube connected with the link bar of the folding frame, whereby the linear actuator is configured to drive the lifting tube to move toward the link bar, so as to push the link bar of the folding frame, and thus cause the wheel to move forward, so as to raise the lifting device, and thus raise the front end of the platform, and whereby when the lifting tube is driven toward the linear actuator, the wheel will be pulled backward, and thus lower the front end of the platform.

5. The foldable treadmill as recited in claim 4, wherein the linear actuator is horizontally placed in the bracket.

6. The foldable treadmill as recited in claim 4, wherein the tracks are U-shaped.

* * * * *